US007473114B2

(12) United States Patent
Chen et al.

(10) Patent No.: US 7,473,114 B2
(45) Date of Patent: Jan. 6, 2009

(54) ELECTRICAL CONNECTOR ASSEMBLY WITH GUIDING MEMBER

(75) Inventors: Hsiang-Ping Chen, Tu-Cheng (TW); Tsu-Yang Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/788,612

(22) Filed: Apr. 20, 2007

(65) Prior Publication Data

US 2007/0249200 A1 Oct. 25, 2007

(30) Foreign Application Priority Data

Apr. 20, 2006 (CN) ..... 200620072741

(51) Int. Cl.
*H01R 13/62* (2006.01)

(52) U.S. Cl. ..... 439/159

(58) Field of Classification Search ..... 439/159, 439/630, 135, 940, 353, 638, 350, 677, 607–610
See application file for complete search history.

(56) References Cited

U.S. PATENT DOCUMENTS 6,164,990 A * 12/2000 Yu et al. ..... 439/135
6,663,434 B1 * 12/2003 Wu ..... 439/638
2005/0070129 A1 * 3/2005 Zhang et al. ..... 439/61

* cited by examiner

*Primary Examiner*—Edwin A. Leon
(74) *Attorney, Agent, or Firm*—Wei Te Chung

(57) ABSTRACT

An electrical connector assembly includes an elongated connector body (31) formed from an insulative material, and a guiding member unitary with the connector body. The connector body includes a front face (311) adapted to face conductive elements (20) of a mating electronic component (2). A plurality of contact terminals (32) is adapted to be disposed within the connector body, and extend from the front face for mating with the conductive elements. The guiding member includes a pair of axial guiding legs (340) transverse to the front face, the guiding legs spaced apart a distance for facilitating insertion of the electronic component along the guiding legs to mate the conductive elements to the terminals of the connector body. As compared with the prior art, the unity of the supporting frame and the connector body makes the manufacturing of the electrical connector assembly simplified, with reduced manufacturing time.

9 Claims, 4 Drawing Sheets

ELECTRICAL CONNECTOR ASSEMBLY WITH GUIDING MEMBER

BACKGROUND OF THE INVENTION

1. Field of the Invention

The present invention relates to the art of electrical connectors, and more particularly to an electrical connector assembly including a guiding member for facilitating insertion of an electronic component along the guiding member to mate with an electrical connector.

2. Description of the Related Art

One conventional electrical connector assembly is shown in FIG. 4 to include an electrical connector 4' and a supporting frame 1' for establishing an electrical interconnection between an electronic component 2', such as a hard disk, and a substrate 3'. The electrical connector 4' is mechanically attached to the supporting frame 1', which defines a pair of axially guiding legs 11' spaced apart a distance for facilitating lateral insertion of the hard disk 2' along the guiding legs 11' so as to electrically mate with the electrical connector 4', which is placed around a rear end of the supporting frame 1'. Each of the guiding legs 11' is provided with a resilient piece 12' on a lateral surface thereof in order to hold the hard disk 2' inserted in position by the pair of lateral resilient pieces 12'. Since the supporting frame 1' and the electrical connector 4' are two separate elements, manufacturing of the separate electrical connector 4' and the supporting frame 1' becomes normally complicated and time consuming. Therefore, there is a need to provide a new electrical connector assembly to resolve the above-mentioned shortcoming.

SUMMARY OF THE INVENTION

An electrical connector assembly according to an embodiment of the present invention includes an electrical connector having an elongated connector body, and a guiding member integral or unitary with the connector body. The connector body is formed of an insulative material, and includes a front face adapted to face conductive elements of a mating electronic component. A plurality of contact terminals is adapted to be disposed within the connector body, and extend from the front face for mating with the conductive elements. The guiding member includes a pair of axial guiding legs transverse to the front face of the connector body, the guiding legs spaced apart a distance for facilitating insertion of the mating electronic component along the pair of guiding legs to mate the conductive elements to the terminals of the connector body. As compared with the prior art, the unity of the supporting frame and the connector body makes the manufacturing of the electrical connector assembly simplified, with reduced manufacturing time.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
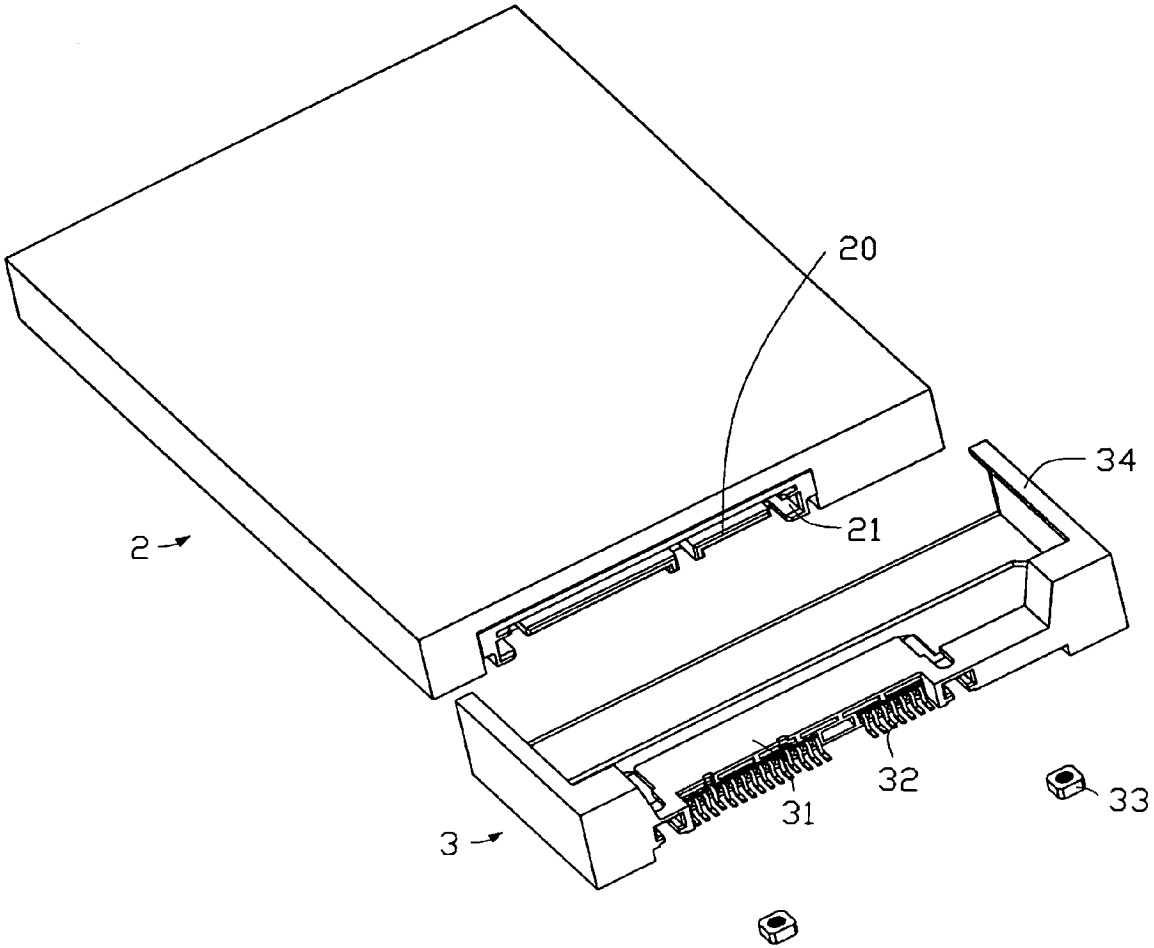
FIG. 1 is an exploded, perspective view of an electrical connector assembly according to an embodiment of the present invention.
Figure 2:
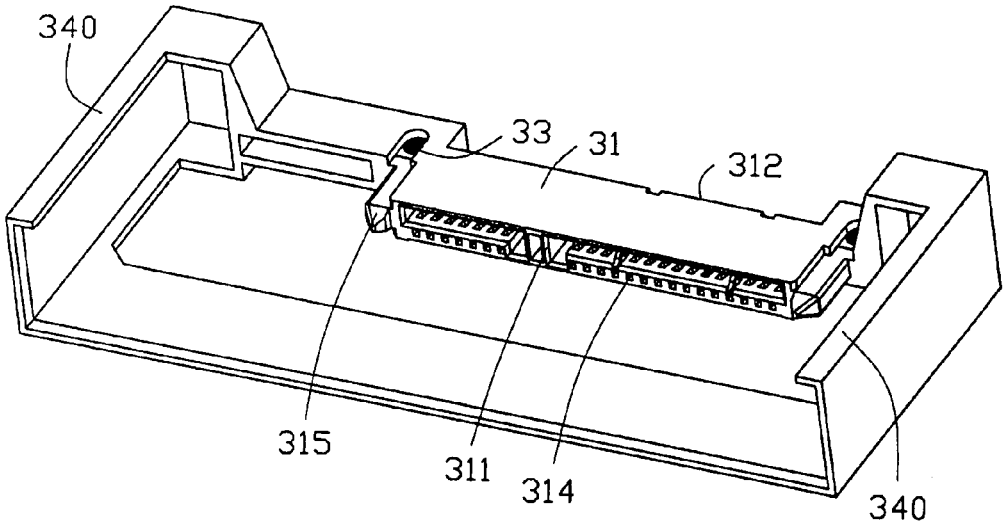
FIG. 2 is a perspective view of an electrical connector of FIG. 1.
Figure 3:
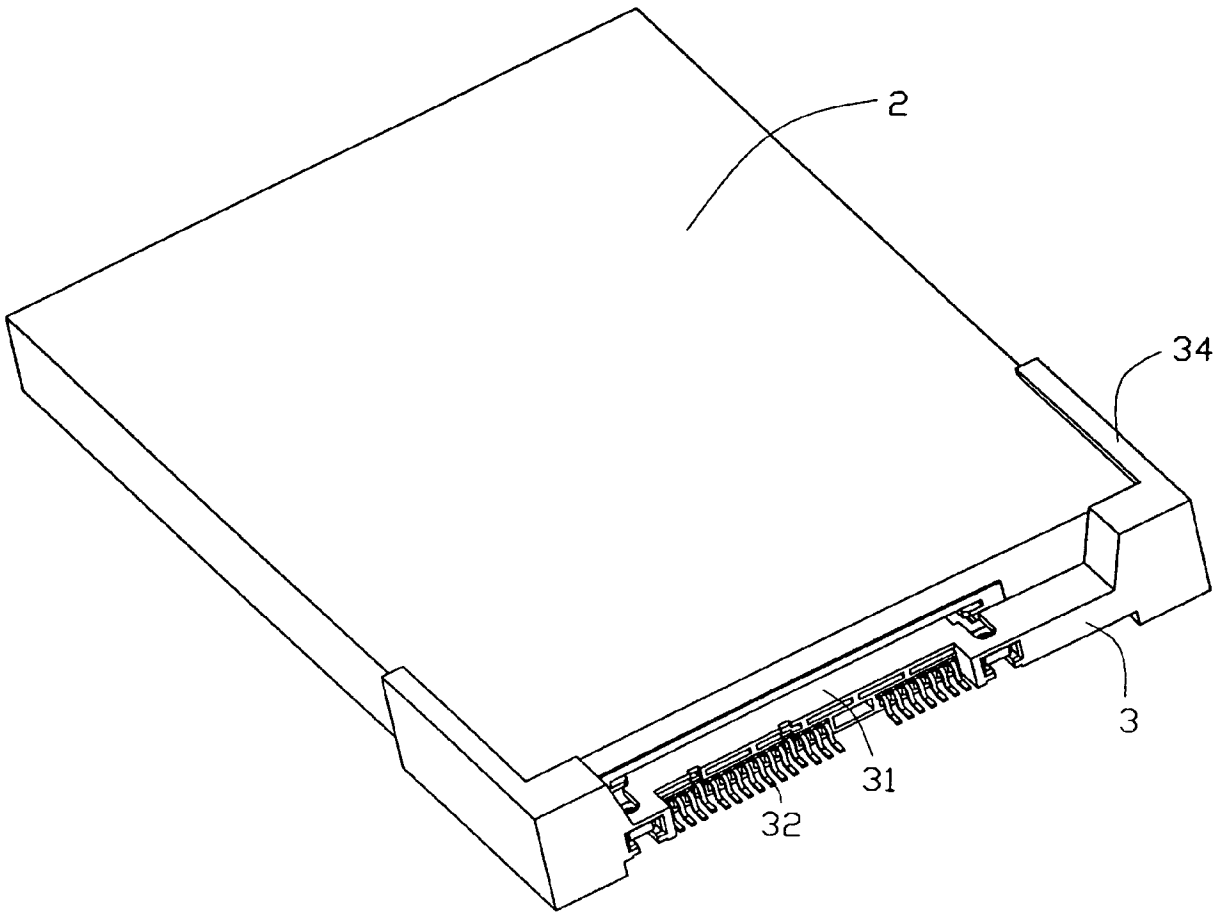
FIG. 3 is an assembled, perspective view of the electrical connector assembly of FIG. 1.
Figure 4:
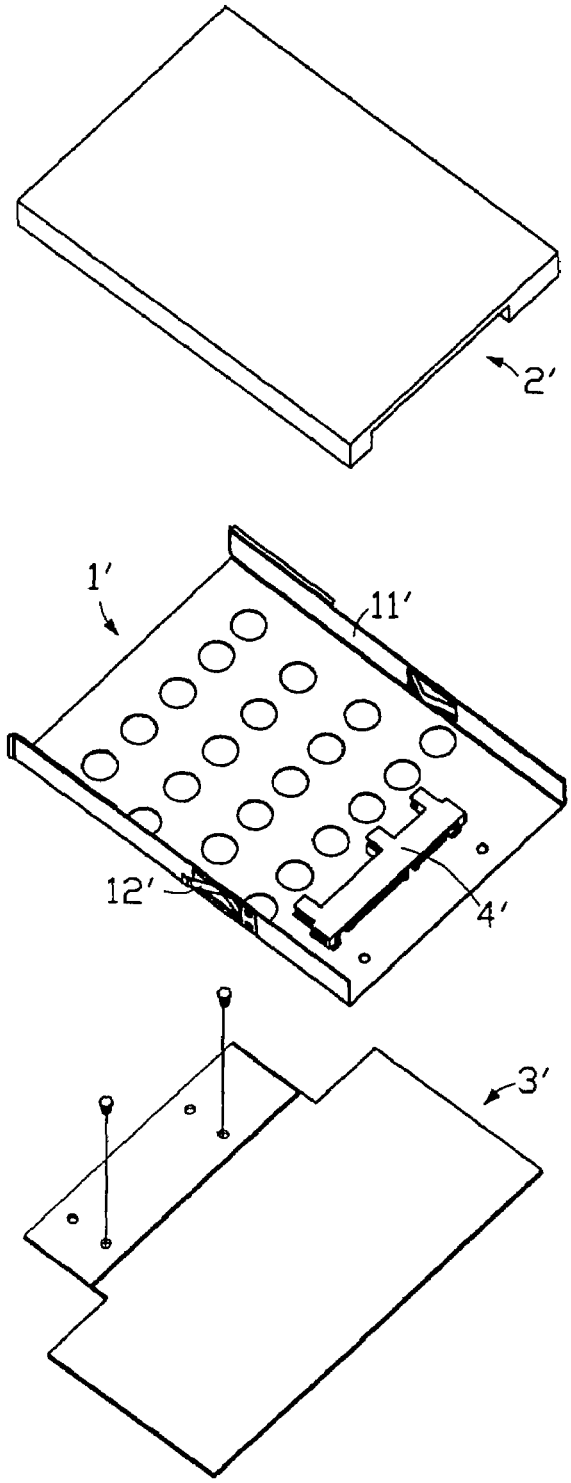
FIG. 4 (PRIOR ART)
FIG. 4 is an exploded, perspective view of a conventional electrical connector assembly.

Referring to FIGS. 1 to 3, an electrical connector assembly is shown to include an electrical connector 3 having a supporting frame 34 integral with the electrical connector 3 for establishing an electrical interconnection between two parallel electrical members, such as a hard disk member 2 and a substrate (not shown).

Referring particularly to FIG. 2, the electrical connector 3 includes a substantially elongated connector body 31, which defines a front mating face 311 for facing conductive elements or contacts 20 from the mating hard disk member 2, and a back mounting face 312 located adjacent the substrate, and a plurality of passages 314 extending from the front mating face 311 towards the back mounting face 312 and adapted for receiving respective contact terminals 32 therein. As shown in FIG. 1, a plurality of contact terminals 32 is adapted to be disposed within the respective passages 314 of the connector body 31, and extend from the front face 311 for mating with the conductive elements 20 of the hard disk member 2. The connector body 31 is formed of an insulative material commercially used in the connector field. The connector body 31 further includes a pair of locating elements 315 integrally attached to opposite side surfaces of the connector body 31 for insertion into respective receptacles 21 of the hard disk member 2 so as to secure the hard disk member 2 onto the connector body 31 when the hard disk member 2 electrically mates with the electrical connector 3. A pair of longitudinally extending apertures 33 is defined on the connector body 31 and adjacent the respective locating elements 315 for receiving fastening elements 33 (a part thereof shown) therein so as to form a mechanical interconnection between the electrical connector 3 and the substrate by means of the fastening elements 33.

The supporting frame 34 is arranged integral or unitary with the connector body 31, and preferably made from an insulative material identical to that of the connector body 31. In this preferred embodiment, the supporting frame 34 and the connector body 31 is made from an identical insulative material by a common molding process. As compared with the prior art, the unity of the supporting frame 34 and the connector body 31 makes the manufacturing of the electrical connector assembly simplified, with reduced manufacturing time. The supporting frame 34 includes a guiding member having a pair of axial guiding legs 340 transverse to the front face 311 of the elongated connector body 31, the guiding legs 340 spaced apart a distance for facilitating insertion of the hard disk member 2 along the pair of guiding legs 340 so as to mate the conductive elements 20 with the terminals 32 of the connector body 31.

Referring to FIGS. 1 and 3, in assembly, the electrical connector 3 is secured to the substrate by the fastening elements 33 insertable into the apertures 33 of the connector body 31. The hard disk member 2 is laterally insertable into the pair of guiding legs 340 in order to mate the conductive elements 20 of the hard disk member 2 with the terminals 32 of the connector 3, and secured to the connector body 31 by the locating elements 315 of the connector body 31 insertable into the respective receptacles 21 of the hard disk member 2.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly comprising:

an electrical connector, having:

an elongated connector body formed of an insulative material, the connector body defining opposite first and second sides and including a front face adapted to face conductive elements of a mating electronic component; and a plurality of contact terminals adapted to be disposed within the body of the electrical connector, the terminals extending from the front face for mating with the conductive elements; and a guiding member integral with the connector body, the guiding member including a pair of axial guiding legs transverse to the front face of the connector body, the guiding legs spaced apart a distance for facilitating insertion of the electronic component along the pair of guiding legs to mate the conductive elements with the terminals of the connector body, wherein one of said guiding legs is located with a first distance from the first side of the connector body, the other of said guiding legs is located with a second distance from the opposite second side of the connector body, said first distance being smaller than the second distance.

2. The electrical connector assembly of claim 1, wherein the connector body includes a pair of locating elements attached to opposite side surfaces of the connector body for securing the electronic component to the connector body when the electronic component mates with the electrical connector.

3. The electrical connector assembly of claim 1, wherein the guiding member is made from an insulative material identical to that of the connector body.

4. An electrical connector assembly comprising:

a hard disk drive having a first connection port located at a front end thereof; and an electrical connector having a second connection port mated with the first connection port, said second connection port including a long section and a short section along a longitudinal direction of the connection port;

the electrical connector integrally defining at least a pair of guide arms located beside two longitudinal ends of the second connection port and dimensioned to be compliant with a width of said hard disk drive; wherein the long section is adjacent to one of said guide arms with a first distance while the short section is adjacent to the other one with a second distance, said first distance being smaller than the second distance.

5. The electrical connector assembly as claimed in claim 4, wherein each of said guide arms defines a channel therein to retain a corresponding side of the hard disk drive.

6. The electrical connector assembly as claimed in claim 4, wherein each of said guide arms defines a height in a vertical direction perpendicular to said longitudinal direction and a mating direction of said second connection port, and the second connection port is dimensioned to be smaller than said height and is essentially located at a lower level of said height.

7. The electrical connector assembly as claimed in claim 4, wherein the electrical connector has an insulative body integrally defining the guiding arms, which also made from an insulative material identical to that of the connector body.

8. An electrical connector assembly comprising:

a hard disk drive having a first connection port located at a front end thereof; and an electrical connector having a second connection port mated with the first connection port, said second connection port defining a longitudinal direction thereof;

the electrical connector integrally defining at least a pair of guide arms located beside two longitudinal ends of the second connection port and dimensioned to be compliant with a width of said hard disk drive; wherein each of said guide arms defines a height in a vertical direction perpendicular to said longitudinal direction and a mating direction of said second connection port, and the second connection port is dimensioned to be smaller than said height and is essentially located at a lower level of said height.

9. The electrical connector assembly as claimed in claim 8, wherein the electrical connector has an insulative body integrally defining the guiding arms, which also made from an insulative material identical to that of the connector body.

* * * * *